United States Patent [19]

Surko, Jr.

[11] 4,419,786

[45] Dec. 13, 1983

[54] DOOR CLOSER ASSEMBLY

[75] Inventor: Walter E. Surko, Jr., Southington, Conn.

[73] Assignee: Emhart Industries, Inc., Farmington, Conn.

[21] Appl. No.: 223,398

[22] Filed: Jan. 8, 1981

[51] Int. Cl.[3] ..... E05F 3/00; E05F 15/04

[52] U.S. Cl. ..... 16/51; 16/62; 49/137

[58] Field of Search ..... 16/49, 51, 65, 61, 62, 16/66, 67, 69, 70, 78, 79, 80, 85, DIG. 9, DIG. 10; 49/137, 265, 273, 274, 341, 386

[56] References Cited

U.S. PATENT DOCUMENTS

| | | | |
|---|---|---|---|
| 2,598,958 | 6/1952 | Wood | 16/DIG. 9 |
| 2,664,590 | 1/1954 | Allen | 16/DIG. 9 |
| 3,072,954 | 1/1963 | Patriquin | 16/66 |
| 3,936,977 | 2/1976 | Runft | 49/137 |
| 4,010,572 | 3/1977 | Peterson | 16/62 X |
| 4,080,687 | 3/1978 | Jentsch | 16/51 X |

*Primary Examiner*—E. R. Kazenske
*Assistant Examiner*—John S. Brown
*Attorney, Agent, or Firm*—McCormick, Paulding & Huber

[57] ABSTRACT

A door closer assembly for controlling the operation of a door relative to a door frame includes a door closer mounted on the door and an articulated arm assembly which has one end attached to the door closer and the other end pivotally secured to a slide block which travels in a track mounted on the door frame. The slide block is affixed to a piston rod, which comprises part of a fluid piston-cylinder assembly also mounted on the door frame, and is located at the end of the track remote from the hinged edge of the door when the door is fully closed. When the door is opened beyond a predetermined angular position relative to the door frame the slide block moves within the track and in the direction of the hinged edge to another location within the track wherein it is releasably retained by the piston-cylinder assembly until the door is nearly fully closed by the reaction force of the door closer. As the door approaches its fully closed position a valve actuator mounted on the door operates a control valve to release the holding force of the piston-cylinder assembly and allow the slide block to be biased to its location at the remote end of the track by a spring contained within the piston-cylinder assembly.

27 Claims, 8 Drawing Figures

DOOR CLOSER ASSEMBLY

BACKGROUND OF THE INVENTION

This invention relates in general to door closing devices and deals more particularly with an improved door closer assembly of the type which includes a door closer and a closer arm assembly. A typical door closer assembly of the aforedescribed general type is connected between a door and its frame to exert a closing force on the door when it is released in an open position. Such a door closer usually includes a relatively strong closer spring, which provides a reactive force for closing the door, and a dampening mechanism, which resists the force of the closer spring and controls the speed at which the door closes. The closer assembly must provide sufficient closing force to close the door against normally anticipated wind force or pressure within the building. If the door is equipped with a latch mechanism the closer assembly must also provide sufficient closing force, as the door approaches its closed position, to assure proper latching. The closer spring is prestressed so that the closer assembly exerts some force on the door in a closing direction even when the door is closed. This closing force must be overcome when the door is opened. Ordinarily, the force which must be applied to open a closer equipped door is somewhat greater during the initial portion of the opening movement and decreases as the door opens. Children, elderly and handicapped persons often encounter difficulty in opening doors provided with such closer assemblies particularly where the doors are heavy and the door closers are of the heavy duty type. It is the general aim of the present invention to provide an improved door closer assembly which enables opening of an associated door with relatively light applied force which remains generally constant throughout a range of door opening movement and which exerts a conventional relatively strong reactive or closing force upon the door to close it.

SUMMARY OF THE INVENTION

An improved door closer assembly for connection between door and frame members to move the door member from open to closed position relative to the frame member includes a door closer, mounting means for attaching the door closer to one of the members, connecting means attached to the door closer for applying closing force to the door, linking means for securing the connecting means to the other of the members for movement along a predetermined path relative to the other member and from one location to another location relative to said other member in response to movement of the door to an open position, and means for releasably retaining the linking means at the other location while the door is open and until the door is moved to a substantially closed position by closing force applied by said connecting means.

DETAILED DESCRIPTION OF PREFERRED EMBODIMENT

Figure 1:
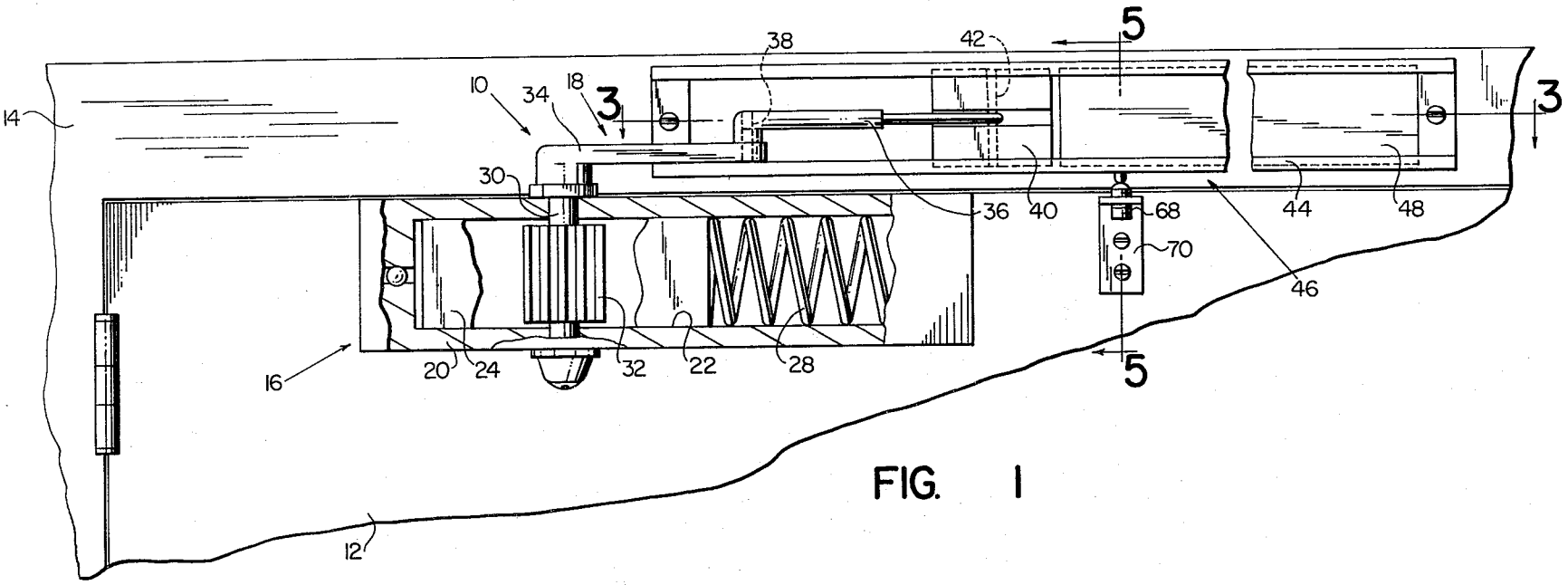
FIG. 1 is a fragmentary elevational view of a door closer assembly embodying the present invention mounted between a door member and a frame member and shown with a portion of the door closer housing broken away to reveal structure therein.
Figure 2:
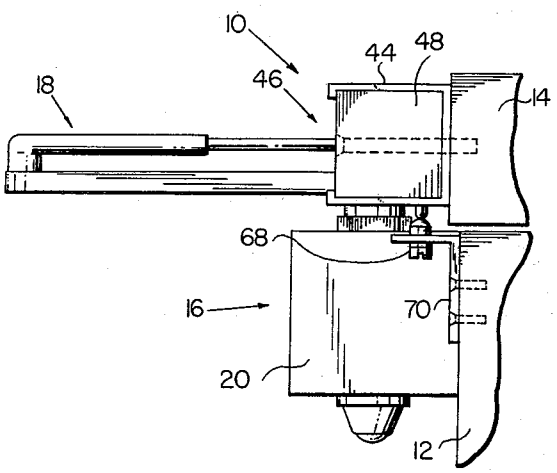
FIG. 2 is a fragmentary end elevational view of the structure shown in FIG. 1.
Figures 3, 7:
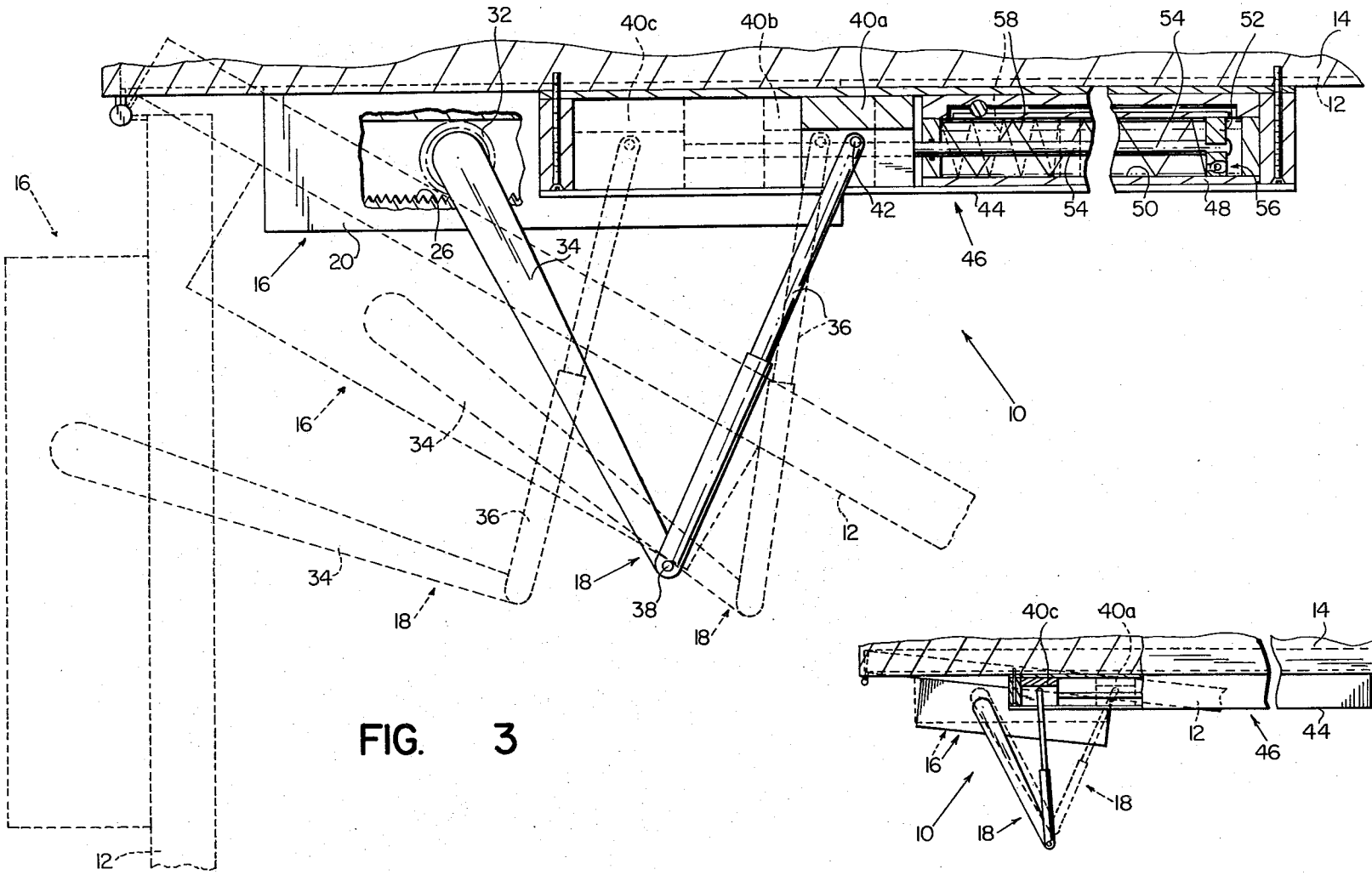
FIG. 3 is a sectional view taken along the line 3—3 of FIG. 1, the door member being shown in fully closed position and open positions of the door being indicated in broken lines.
FIG. 7 is a somewhat reduced plan view of the mounted door closer assembly of FIG, 1, the door shown approaching its closed position, the position of the closer arms when the door is closed being indicated in broken lines.

Turning now to the drawings, a door closer assembly embodying the present invention and indicated generally by the reference numeral 10 is shown in FIGS. 1–3 mounted between a door 12 and a door frame 14. The door 12 is supported by hinges (one shown) for swinging movement about a vertical axis between open and closed positions relative to the door frame. Movement of the door relative to the door frame is controlled by the door closer assembly 10 which includes a door closer, designated generally by the numeral 16, mounted on one of the members which comprise the door and door frame, and a linking mechanism or articulated arm assembly indicated generally at 18 and connected between the door closer 16 and the other of the members. The door closer mounting arrangement may vary, however, the illustrated door closer 16 is a right-hand closer and is shown mounted on the inner face of an inwardly opening right-hand door. The arm assembly 18 is operably connected between the door closer 16 and the door frame 14, as will be hereinafter further discussed.

The illustrated door closer 16 is a conventional type and has a housing 20 mounted in fixed position on the inner surface of the door 12. The housing has a cylindrical chamber 22 which contains a double acting piston 24 formed with an integral rack 26 intermediate its ends, as shown in FIG. 3. At least one closer spring 28 contained within the housing 20 acts between one end of the housing and the piston 24 to bias the piston toward the other end of the housing. A control element or rotary spindle 30, journalled within the housing for rotation about a vertical axis, has at least one end portion exposed externally of the housing, as shown in FIG. 1, and includes a pinion 32 in meshing engagement with the integral rack 26, as shown in FIG. 3. A quantity of hydraulic fluid contained within the housing 20 cooperates with the piston 24 and valves (not shown), which control the fluid flow through and around the piston, to dampen movement of the piston and its associated spindle 30, in a manner well known in the door closer art. The illustrated door closer 16 may be of any convenient kind and may, for example, comprise a door closer of 59 Series, 500 Series or 2800 Series, manufactured and marketed by Russwin Division of Emhart Industries, Inc., Berlin, Conn.

The arm assembly 18 includes a pair of articulated arms 34 and 36. One end of the arm 34 is secured in fixed position to the externally exposed upper end of the spindle 30. The other end of the arm 34 is connected by a pivot pin 38 to an associated end of the arm 36, which is of an adjustable length. The opposite end of the arm 36, hereinafter referred to as the operational end, is movably connected to the door frame 14 for translation along a predetermined rectilinear path relative to the door frame. More specifically, the operational end of the arm 36 is pivotally connected to a slide block 40 by a pivot pin 42. The slide block 40 is slidably received within a track or channel 44 mounted in fixed position on the door frame 14 and is constrained by the channel to move along a generally rectilinear path generally toward and away from the hinged edge of the door, as will be hereinafter further discussed. When the door 12 is fully closed the block 40 is at one location, indicated at 40*a* in FIG. 3, the one location being at an end of the track 44 farthest from the hinged edge of the door. The block 40 is movable in the direction of the hinged edge and toward the other end of the track and to another location 40*c* at the other end of the track. In moving from its location 40*a* to its location 40*c* the block 40 attains an infinite number of other locations including the typical location, 40*b*, shown in FIG. 3, each of the other locations corresponding to a particular open position of the door 12.

Further, and in accordance with the present invention, the closer assembly 10 includes a retaining mechanism indicated generally at 46 for releasably retaining the operational end of the arm 36 at one of its other locations, such as the location 40*b* or 40*c*, shown in FIG. 3. Various means may be provided for releasably retaining the operational end of the arm 36, however, the illustrated retaining mechanism 46 comprises a closed loop hydraulic system.

Figure 4:
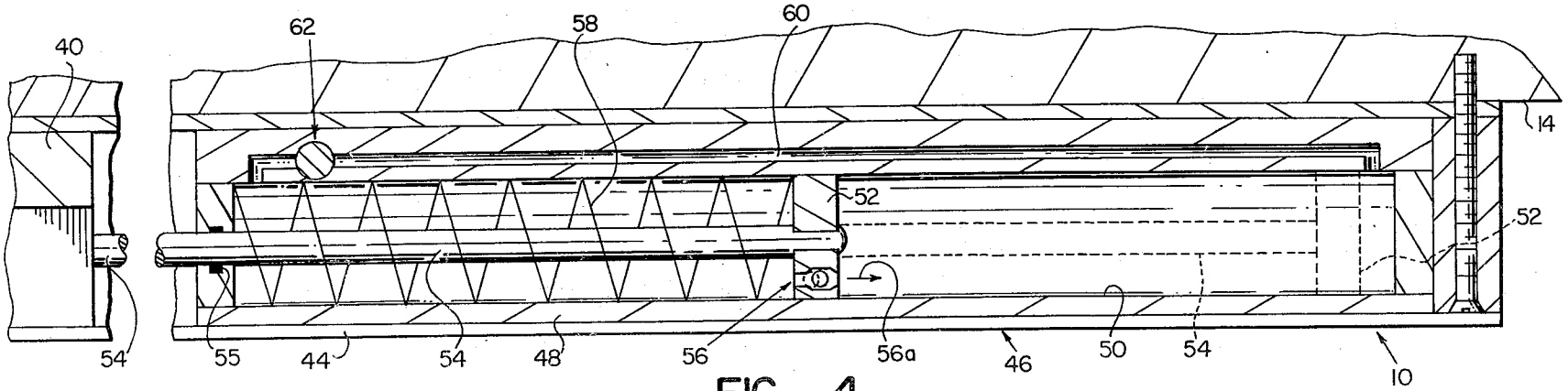
FIG. 4 is a somewhat enlarged fragmentary sectional view of the slide block retaining mechanism shown in FIG. 3.
Figure 5:
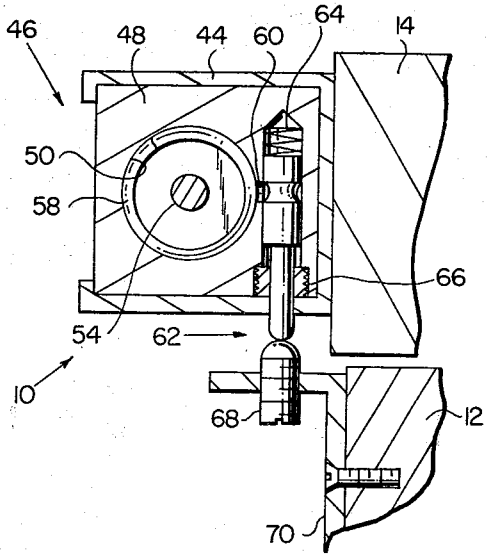
FIG. 5 is a sectional view taken along the line 5—5 of FIG. 1, the door being shown in a fully closed position.
Figure 6:
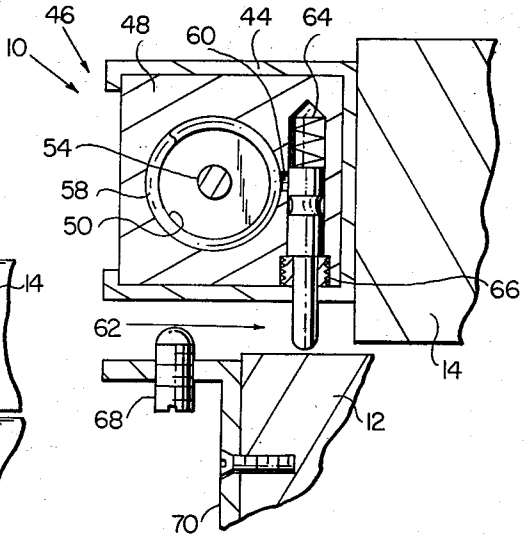
FIG. 6 is similar to FIG. 5, but shows the door near its fully closed position.

Referring now particularly to FIG. 4, the retaining mechanism 46 comprises a fluid piston-cylinder assembly and includes an elongated housing 48, which, as shown, is mounted within the channel 44. The housing 48 defines a cylinder 50 which extends longitudinally of the channel 44. A piston assembly mounted within the cylinder includes a piston 52 and a piston rod 54 which has its inner end connected to the piston 52 and which extends outwardly through one end of the housing 48. A suitable annular seal 55 is mounted within said end of the housing 48 in surrounding relation with the piston rod 54. The outer end of the piston rod 54 is connected to the slide block 40. A ball check valve indicated generally at 56 and disposed within the piston 52 permits fluid to flow through the piston and in a direction indicated by the directional arrow 56*a* in FIG. 4, but prevents retrograde fluid flow through the piston. The retaining mechanism 46 further includes a biasing spring 58 which normally urges the piston 52 toward the end of the housing 46 remote from the hinged edge of the door. An elongated fluid flow passageway 60 formed in the inboard side of the housing 48 communicates with opposite ends of the cylinder 50, as best shown in FIG. 4. Fluid flow through the passageway 60 is controlled by a fluid control valve or spool valve, indicated generally at 62 and supported for axially vertical sliding movement within the housing 48 in intersecting relation with the passageway 60, as best shown in FIGS. 5 and 6. A biasing spring 64 acts between the housing and the upper end of the spool valve 62 to bias the spool valve to closed position in seating engagement with a threaded fitting 66 which retains the spool valve 62 in assembly with the housing 48. The spool valve 62 is operated by an adjustable valve actuator 68 carried by a bracket 70 mounted in fixed position on the inner face of the door 12. The actuator 68 is vertically aligned with the lower end of the spool valve when the door is closed, as it appears in FIGS. 2 and 5, and is threaded into the bracket 70 for vertical adjustment generally toward and away from the lower end of the spool valve 62, as may be necessary to assure proper valve operation.

Considering now the operation of the closer assembly 10, when the door 12 is fully closed, as it appears in FIGS. 1, 2 and 5 and in full lines in FIG. 3, the spool valve 62 is held open by the actuator 68, as best shown in FIG. 5, so that the passageway 60, best shown in FIG. 4, provides fluid communication between the opposite ends of the cylinder 50. The piston rod 52 is maintained in its full line position of FIG. 3. by the spring 58. The slide block 40 connected to the piston rod 54 is at its location 40*a*, indicated by solid lines in FIG. 3, and is held at location 40*a* by the biasing force of the spring 58.

Initial opening movement of the door 12 in response to applied opening force causes the valve actuator 68 to move out of holding engagement with the spool valve 62 which allows the latter valve to be biased to closed position by its associated spring 64, as it appears in FIG. 6, to interrupt fluid communication between opposite ends of the cylinder 50. This initial opening movement of the door puts the closer arm 36 under increased tension and cranks the closer arm 34 in counterclockwise direction, as viewed from above in FIG. 3, as the door is moved in a clockwise or opening direction thus rotating the pinion 32 which, in turn, moves the piston 24 to compress the spring 28. The tension on the arm 36 may be resolved into two force components which act upon the pivot pin 42. The first of these two components acts perpendicular to the door frame 14 in the opening direction. The second component acts parallel to the door frame and in the direction of the hinged edge of the door. When the magnitude of this second force component is sufficient to overcome the opposing biasing force of the spring 58 and friction within the system, in block 40 will begin to slide within the track 44 from its location 40*a* toward its location 40*c* at the opposite end of the track. Preferably, the system is designed so that the block 40 will remain at its position 40*a* until the door has opened to a predetermined position, as, for example, an angular position of from 30 to 45 degrees with respect to the door frame, so as to retain the mechanical advantage attained by the mechanism during the initial portion of the opening movement of the door and thus minimize the initial force that is required to open the door.

Since the spool valve 62 is in closed position while the door is being opened, hydraulic fluid contained within the cylinder 50 and to the left of the piston 52, as it appears in FIGS. 3 and 4, is constrained to flow through the check valve 56, as indicated by the directional flow arrow in FIG. 4, and to the right hand end of the cylinder 50, as the piston 52 moves toward the left hand end of the cylinder. The check valve 56 prevents retrograde flow of fluid through the piston 52 so that fluid which flows through the piston and to the right hand end of the cylinder 50 is trapped within the latter end of the cylinder and prevents return movement of the piston 52 in response to the biasing force of the spring 58. Thus, the retaining mechanism 46 operates to releasably retain the slide block 40 at a location along the track 44 corresponding to a position to which the door has been opened. Thus, when the slide block 40 advances to its location 40*c* it is releasably retained at that location until the door returns to its almost fully closed position.

The force required to compress the closer spring 28 is directly proportional to spring displacement. Therefore, the force which must be applied to the arm 34 to crank the spindle 32 increases as the door opening angle increases. After the slide block reaches its location 40*c* the force required to compress the closer spring 28 continues to increase as the door is further opened. However, the included angle between the closer arms 34 and 36 also increases. As this included angle increases the closer arm 36 acts in a more nearly tangential direction relative to the circular path of the crank arm 34 thereby increasing the mechanical advantage of the arm assembly 18 which tends to offset the increased cranking resistance of the door closer 16. By arranging the operational end of the arm assembly 18 to change position relative to the door frame member 14 after the door has opened to a predetermined position a resulting condition is attained whereby the door may be opened by a relatively light applied opening force which has a generally constant magnitude through a wide range of door opening positions.

When the door 12 is released in an open position the closer assembly 10 functions in a conventional manner to exert closing force on the door. The slide block will normally be at or near its location 40*c*, being retained at the latter location by the retaining mechanism 46. The exact position of the slide block 40 within the channel 44 will, of course, depend upon the angle to which the door has been opened. When the block is at location 40*c*, as it appears in full lines in FIG. 7, the arm assembly 18 is in the position which it would normally be in if the door closer were mounted in a conventional manner in accordance with the manufacturer's instructions to provide maximum closing power.

As the door approaches its fully closed position, FIGS. 6 and 7, the spool valve actuator 68 engages the spool valve 62 and opens it to allow fluid to flow through the passageway 60 from the right hand end of the cylinder to the left hand end thereof. Biasing force exerted by the spring 58 upon the piston 52 causes the piston to move toward the right hand end of the cylinder, as it appears in FIG. 4, to return the slide block 40 to its location 40*a*, shown in broken lines in FIG. 7, which prepares the door to be opened in response to a relatively light opening force applied to it.

Figure 8:
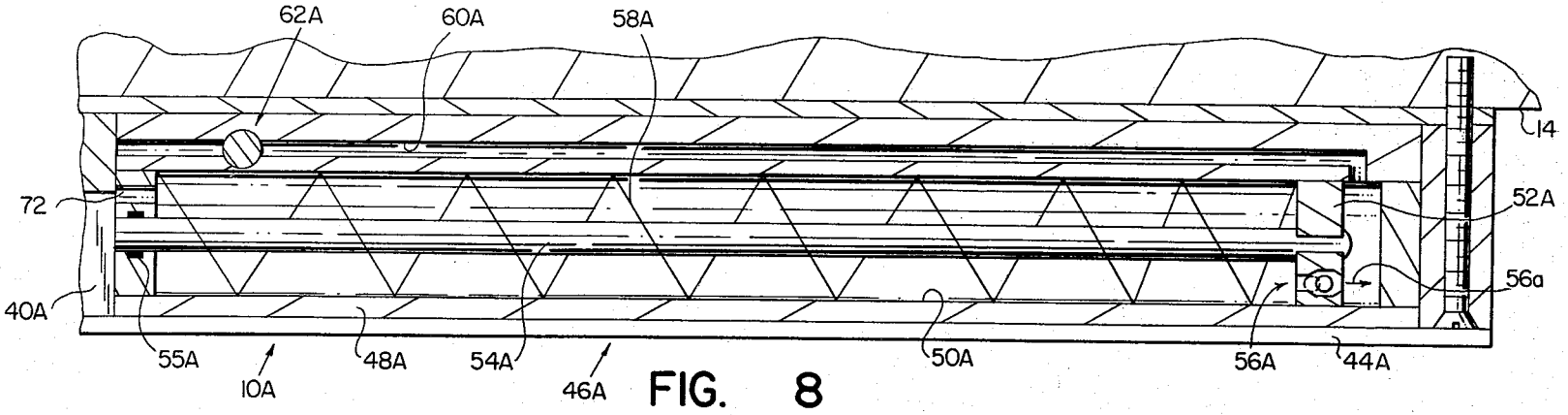
FIG. 8 is a view similar to FIG. 4, but shows another door closer assembly embodying the invention.

A portion of another door closer assembly embodying the invention is indicated generally at 10A in FIG. 8. The closer assembly 10A differs from the closer assembly 10, previously described, in that it has an open loop pneumatic retaining device indicated generally at 46A. The retaining device 46A is similar in many respects to the retaining device 46 previously described. Parts of the device 46A which correspond to parts of the mechanism 46 have a letter A suffix and will not be hereinafter discussed in detail.

The device 46A has a housing 48A which defines an air cylinder 50A. An air intake-exhaust port 72 at the left hand end of the housing 48A, as it appears in FIG. 8, provides communication between the cylinder 50A and atmosphere to allow for the free passage of air into and out of the left hand end of the cylinder 50A. The device 46A further differs from the previously described device 46 in that the passageway 60A opens through the left hand end of the housing 48A and comprises an exhaust port which provides communication between the right hand end of the cylinder 50A and the atmosphere, as shown in FIG. 8.

As the door (not shown) is opened beyond a predetermined open position the slide block 40A moves from its position at the end of the track 44A farthest from the hinged edge of the door and in the direction of the hinged edge to another of its positions carrying with it the piston rod 54A and piston 52A, as previously described. Some of the air contained within the left hand end of the cylinder 50A flows out of the cylinder 50A through the port 72, however, some of the air in the left hand end of the cylinder is constrained to flow through the check valve 56A into the right hand end of the cylinder 50A. Since the spool valve 62A is closed while the door is being opened, as previously described, air which flows into the right hand end of the cylinder 50A is trapped in that end of the cylinder and prevents return movement of the piston 52A under the biasing force of the spring 58A. Thus, the retaining device 46A releasably retains the block 40A in a relatively fixed position within the track 44A at a location which corresponds to the position to which the door is opened. The slide block 40A is releasably retained in the position to which it has moved by the retaining mechanism 46A while the door is open and until the door is substantially closed by the door closer.

As the door reaches its almost fully closed position the spool valve 62A is opened by an associated valve actuator carried by the door, but not shown in FIG. 8, so that air entrapped within the right hand end of the cylinder 50A may be exhausted to atmosphere through the vent passageway or exhaust port 60A. This venting occurs as the spring 58A biases the piston 52A toward the right hand end of the cylinder to return the slide block 40 to its location 40*a*, such as shown in broken lines in FIG. 7, in preparation for the next opening of the door.

By providing a door closer assembly wherein one of the points of door closer connection between a door and its frame is arranged to shift from one location to another location as the door is opened and wherein the one point of connection is maintained at its other location as the door closes, a condition is attained whereby the door is opened by a relatively light opening force, which remains relatively constant as the door is opened. However, the door is closed by a closing force which increases as the door closes which attains its maximum closing force as the door approaches its fully closed position.

I claim:

1. In a door closer assembly for connection between door and frame members relatively movable between open and closed positions, said closer assembly including a door closer having a control element supported for movement in one and an opposite direction, first biasing means for yieldably resisting movement of the control element in the one direction from one position to another position and for moving the control element from the other position to the one position, mounting means for attaching the door closer to one of the members, linking means connected to the door closer for movement with the control element, and connecting means for securing said linking means to the other of the members to move the control element in the one direction in response to movement of the door member in an opening direction relative to the frame member, the improvement wherein said connecting means comprises means for securing an operating portion of said linking means to the other of the members for movement along a predetermined path relative to the other member from one location to another location spaced a substantial linear distance from said one location in response to movement of the door in an opening direction beyond a predetermined position to an open position and retaining means for releasably retaining said connecting means at said other location while the door is in said open position and until the door returns to a closed position.

2. In a door closer assembly as set forth in claim 1 the further improvement wherein said connecting means comprises a track and a block connected to said linking means and constrained for movement along said track.

3. In a door closer assembly as set forth in claim 2 the further improvement wherein said track comprises a channel member and said block is slidably received within said channel member.

4. In a door closer assembly as set forth in claim 2 the further improvement wherein said linking means is pivotally connected to said block.

5. In a door closer assembly as set forth in any one of claims 1 through 4 wherein said door member is mounted on said frame member for pivotal movement between open and closed positions the further improvement wherein said linking means comprises an articulated arm assembly.

6. In a door closer assembly as set forth in claim 1 the further improvement wherein said retaining means comprises an hydraulic mechanism.

7. In a door closer assembly as set forth in claim 6 the further improvement wherein said hydraulic mechanism is further characterized as a closed loop hydraulic mechanism.

8. In a door closer assembly as set forth in claim 7 wherein said hydraulic mechanism comprises a piston-cylinder mechanism.

9. In a door closer assembly as set forth in claim 1 the further improvement wherein said retaining means comprises a pneumatic mechanism.

10. In a door closer assembly as set forth in claim 9 the further improvement wherein said pneumatic mechanism is further characterized as an open loop pneumatic mechanism.

11. In a door closer assembly as set forth in any one of claims 1 or 6–10 the further improvement wherein said closer assembly includes means for controlling and retaining means to release said connecting means as the door attains its closed position.

12. In a door closer assembly as set forth in claim 11 the further improvement wherein said controlling means comprises a control valve carried by one of the members and a control valve actuator carried by the other of the members.

13. In a door closer assembly as set forth in claim 11 wherein said retaining means comprises a piston-cylinder mechanism.

14. In a door closer assembly as set forth in claim 1 the further improvement wherein said closer assembly includes second biasing means for moving said connecting means from said other location to said one location as the door attains its closed position.

15. In a door closer assembly as set forth in claim 14 the further improvement wherein said retaining means comprises said second biasing means.

16. In a door closer assembly for connection between a frame member and a door member hingedly connected to the frame member, said door closer assembly including a door closer having a control element supported for movement in one and an opposite direction, first biasing means for yieldably resisting movement of the control element in the one direction from one position to another position and for moving the control element from the other position to the one position, dampening means for yieldably resisting movement of the control element from the other to the one position, mounting means for attaching the door closer to one of the members including the door member and the frame member, an articulated arm assembly including a pair of arms, one of said arms connected to the door closer for movement with the control element, and connecting means for securing the other of said arms to the other of the members to move the control element in the one direction in response to movement of the door member in an opening direction, the improvement wherein said connecting means comprises means for securing the operating end of said other arm to the other of the members for movement along a predetermined path relative to the other member from one location to another location spaced a substantial linear distance from said one location in response to movement of the door in an opening direction beyond a predetermined position to an open position, said other location corresponding to said open position, retaining means for releasably securing said connecting means at said other location while the door is in said open position, and controlling means for releasing said retaining means as the door attains its closed position.

17. In a door closer assembly for connection between a frame member and a door member hingedly connected to the frame member, said door closer assembly including a door closer having a control element supported for movement in one and an opposite direction, first biasing means for yieldably resisting movement of the control element in the one direction from one position to another position and for moving the control element from the other position to the one position, dampening means for yieldably resisting movement of the control element from the other to the one position, mounting means for attaching the door closer to one of the members including the door member and the frame member, an articulated arm assembly including a pair of arms, one of said arms connected to the door closer for movement with the control element, and connecting means for securing the other of said arms to the other of the members to move the control element in the one direction in response to movement of the door member in an opening direction, the improvement wherein said connecting means comprises means for securing the operating end of said other arm to the other of the members for movement along a predetermined path relative to the other member from one location to another location in response to movement of the door in an opening direction beyond a predetermined position to an open position, said other location corresponding to said open position, retaining means for releasably securing said connecting means at said other location while the door is in said open position, controlling means for releasing said retaining means as the door attains its closed position, and second biasing means for biasing said connecting means to said one position when said retaining means is released by said controlling means.

18. In a door closer assembly as set forth in claim 17 the further improvement wherein said connecting means comprises a track and a block supported for rectilinear movement along said track and pivotally connected to said arm assembly means.

19. In a door closer assembly as set forth in claim 18 the further improvement wherein said retaining means includes a piston-cylinder mechanism mounted in fixed position relative to the other of the members and having a cylinder containing a piston and a quantity of fluid and said retaining means further includes a piston rod connecting said piston and said block.

20. In a door closer assembly as set forth in claim 19 the further improvement wherein said second biasing means comprises a spring contained within said cylinder and acting upon said piston.

21. In a door closer assembly as set forth in claim 19 the further improvement wherein said controlling means comprises a fluid control valve and an actuator for operating said control valve in response to movement of the door into closed position.

22. In a door closer assembly as set forth in claim 21 the further improvement wherein said retaining means comprises a closed loop hydraulic mechanism.

23. In a door closer assembly as set forth in claim 21 the further improvement wherein said retaining means comprises an open loop pneumatic mechanism.

24. A door closer assembly for connection between door and door frame members and comprising a door closer, means for mounting said door closer on one of the members, linking means attached to said door closer for applying closing force to the door, connecting means for securing said linking means to the other of said members for movement along a predetermined path from one location to another location spaced a substantial linear distance from said one location relative to said other member in response to movement of the door to an open position, and means for releasably retaining said connecting means at said other location while the door is open and until the door is moved to a substantially closed position by the closing force applied by said linking means.

25. A door closer assembly for connecting between door and frame members and comprising a door closer having a rotary part, means for mounting said door closer on one of said members, linking means attached to said rotary part and for attachment to the other of said members to apply closing force to the door, connecting means for attaching said linking means to the other of the members to pivot about a movable pivot axis relative to the other of said members, said pivot axis being movable from one location to another spaced a substantial linear distance from said one location in response to opening movement of the door, said other location being closer to said rotary member than said one location, and means for releasably retaining said pivot axis at said other location while the door member is open and until said door member is moved to a substantially closed position by the closing force applied by said linking means.

26. A door closer assembly as set forth in claim 25 wherein said pivot axis is movable from said other location to said one location in response to closing movement of the door member.

27. A door closer assembly as set forth in claim 25 wherein said assembly includes means for retaining said pivot axis at said one location until the door member is opened to a predetermined open position relative to the frame member.

* * * * *